US009290310B2

(12) United States Patent
Sinn et al.

(10) Patent No.: US 9,290,310 B2
(45) Date of Patent: Mar. 22, 2016

(54) RESEALABLE LID CONTAINER

(75) Inventors: Mark Sinn, Plymouth, MA (US); Joseph Sullivan, Duxbury, MA (US)

(73) Assignee: CDF CORPORATION, Plymouth, MA (US)

( * ) Notice: Subject to any disclaimer, the term of this patent is extended or adjusted under 35 U.S.C. 154(b) by 0 days.

(21) Appl. No.: 13/606,622

(22) Filed: Sep. 7, 2012

(65) Prior Publication Data

US 2013/0206763 A1 Aug. 15, 2013

Related U.S. Application Data

(60) Provisional application No. 61/532,926, filed on Sep. 9, 2011.

(51) Int. Cl.

| | |
|---|---|
| ***B65D 50/00*** | (2006.01) |
| ***B65D 53/00*** | (2006.01) |
| ***B65D 8/00*** | (2006.01) |
| ***B65D 25/14*** | (2006.01) |
| ***B65D 43/02*** | (2006.01) |
| ***B65B 3/02*** | (2006.01) |
| ***B65D 3/30*** | (2006.01) |

(52) U.S. Cl.

CPC . *B65D 53/00* (2013.01); *B65B 3/02* (2013.01); *B65D 3/30* (2013.01); *B65D 15/22* (2013.01); *B65D 25/14* (2013.01); *B65D 43/021* (2013.01); *B65D 2543/00092* (2013.01); *B65D 2543/00296* (2013.01); *B65D 2543/00435* (2013.01); *B65D 2543/00509* (2013.01); *B65D 2543/00648* (2013.01); *B65D 2543/00685* (2013.01); *B65D 2543/00731* (2013.01); *B65D 2543/00796* (2013.01)

(58) Field of Classification Search

CPC ..... B65D 53/00; B65D 25/14; B65D 43/021; B65D 21/064; B65D 50/046

USPC ..... 220/240, 495.01, 495.02, 495.03, 220/495.06, 495.08, 908.1, 254.1, 254.8, 220/253, 256.1

See application file for complete search history.

(56) References Cited

U.S. PATENT DOCUMENTS

| | | | | |
|---|---|---|---|---|
| 2,015,393 | A | 9/1935 | Drake et al. | |
| 3,058,642 | A | 10/1962 | Hester | |
| 3,620,399 | A | 11/1971 | Rapeaud | |
| 4,444,355 | A | 4/1984 | Cary | |
| 4,466,553 | A * | 8/1984 | Zenger | 220/495.08 |

(Continued)

FOREIGN PATENT DOCUMENTS

| | | |
|---|---|---|
| GB | 789009 A | 1/1958 |
| WO | WO 81/03163 | 11/1981 |

OTHER PUBLICATIONS

International Search Report for International Patent Application No. PCT/US2012/054242 mailed Dec. 13, 2012.

(Continued)

*Primary Examiner* — Fenn Mathew
*Assistant Examiner* — Elizabeth Volz
(74) *Attorney, Agent, or Firm* — Dorsey & Whitney LLP

(57) ABSTRACT

A container for holding contents includes a shell having a peripheral rim defining a substantially open top, a lid positioned on the shell, covering the substantially open top, and having a peripheral portion engaging the peripheral rim, and a liner disposed within the shell, conforming to the shape of the shell, and having peripheral ribbon secured to the lid forming a continuous seal between the liner and the lid.

29 Claims, 5 Drawing Sheets

(56) References Cited

U.S. PATENT DOCUMENTS

| | | | | |
|---|---|---|---|---|
| 4,932,549 | A | 6/1990 | Gouttefangeas | |
| 5,337,915 | A | 8/1994 | Hall, Jr. | |
| 5,799,813 | A * | 9/1998 | Letica | 220/254.1 |
| 6,571,972 | B1 * | 6/2003 | Bouc et al. | 220/254.2 |
| 2002/0088811 | A1 * | 7/2002 | Lu | 220/780 |
| 2010/0147865 | A1 | 6/2010 | Yang et al. | |
| 2010/0219192 | A1 * | 9/2010 | Quan | 220/495.08 |
| 2011/0114714 | A1 | 5/2011 | Sullivan et al. | |

OTHER PUBLICATIONS

International Written Opinion for International Patent Application No. PCT/US2012/054242 mailed Dec. 13, 2012.

European Patent Office, Extended European Search Report for European application No. 128302563.6 dated Mar. 25, 2015, 6 pages.

* cited by examiner

RESEALABLE LID CONTAINER

CROSS-REFERENCE TO RELATED APPLICATION

This application claims priority to U.S. Provisional Application No. 61/532,926, filed Sep. 9, 2011, entitled "RESEALABLE LID CONTAINER," which is incorporated by reference herein, in its entirety.

FIELD OF THE INVENTION

The present application relates to containers such as boxes, buckets, pails, bags, sacks, and other devices for storing and/or transporting contents. More particularly, the present application relates to lined containers for storing and/or transporting solids, liquids, or viscous fluids. Still more particularly, the present application relates to lined containers having liquid tight lids, covers, tops, or other closing devices that are both removable and resealable. Still more particularly the present application relates to a corrugated container having a liner and a lid with a removable and resealable portion.

BACKGROUND

Current storage containers, particularly for paint, for example, suffer from a variety of drawbacks. One particular drawback relates to environmental concerns due to the presence of paint cans being disposed in landfills. Additionally, current paint cans are often made from a metal material and may be relatively heavy when compared to other packaging materials. As such, the heavy weight can result in high shipping costs and fuel consumption. Still further, the generally rigid materials used to make the paint cans require large volumes of space to be used to stockpile the empty cans prior to filling the cans. The round shape of current paint cans results in a large amount of wasted space when the cans are arranged in a rectangular array for shipping on a pallet, for example.

These and other drawbacks of current paint cans are addressed by the present application. While the disclosure uses paint storage, shipping, handling, and use as an example, the container disclosed herein is not limited to use with paint and can be used for a variety of contents.

SUMMARY

In one embodiment, a container for holding contents may include a shell having a peripheral rim defining a substantially open top. The container may also include a lid positioned on the shell, covering the substantially open top, and having a peripheral portion engaging the peripheral rim. The container may also include a liner disposed within the shell, conforming to the shape of the shell, and having a peripheral ribbon secured to the lid forming a continuous seal between the liner and the lid.

In another embodiment, a method of assembling a container may include expanding a shell and a liner from respective collapsed states to expanded states and placing the liner in the shell, the liner having a channel-shaped peripheral ribbon for suspending the liner from a peripheral rim of the shell. The method may also include filling the liner with contents, heating a hot-melt glue arranged on a lid, and pressing the lid onto the liner and securing the lid to the liner. The method may also include securing the lid to the shell with a securing system.

It is to be understood that both the foregoing description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

In one embodiment, the present application relates to a container particularly adapted for containing paint products. A shell portion of the container may include an open top and a liner may be placed into the shell and filled with paint. A lid may be placed over the liner and the shell and secured thereto. The lid may be secured with a hot-melt glue, via friction or a snap fit, an internal or external threaded connection, a gasketed and latched connection, with toothed or other biting-type features, or other connection systems. The container may thus store the paint product and be shipped to retailers and/or end users. A portion of the lid may be removable and resealable such that some or all of the paint in the container may be accessed and withdrawn from the container for use. Where only a portion of the paint is withdrawn, the portion of the lid may be replaced, thereby allowing for further storage and/or shipping and/or handling of the container while preserving the paint for later use.

While the embodiment described refers to use of the container with paint products, it is to be appreciated that the container may be used for most any type of contents including solids or other liquids including food products, detergents, cleaning agents or other chemicals, or cooking products such as oils, spreads, condiments, and the like. The container may also be used with other types of contents.

Figure 1:
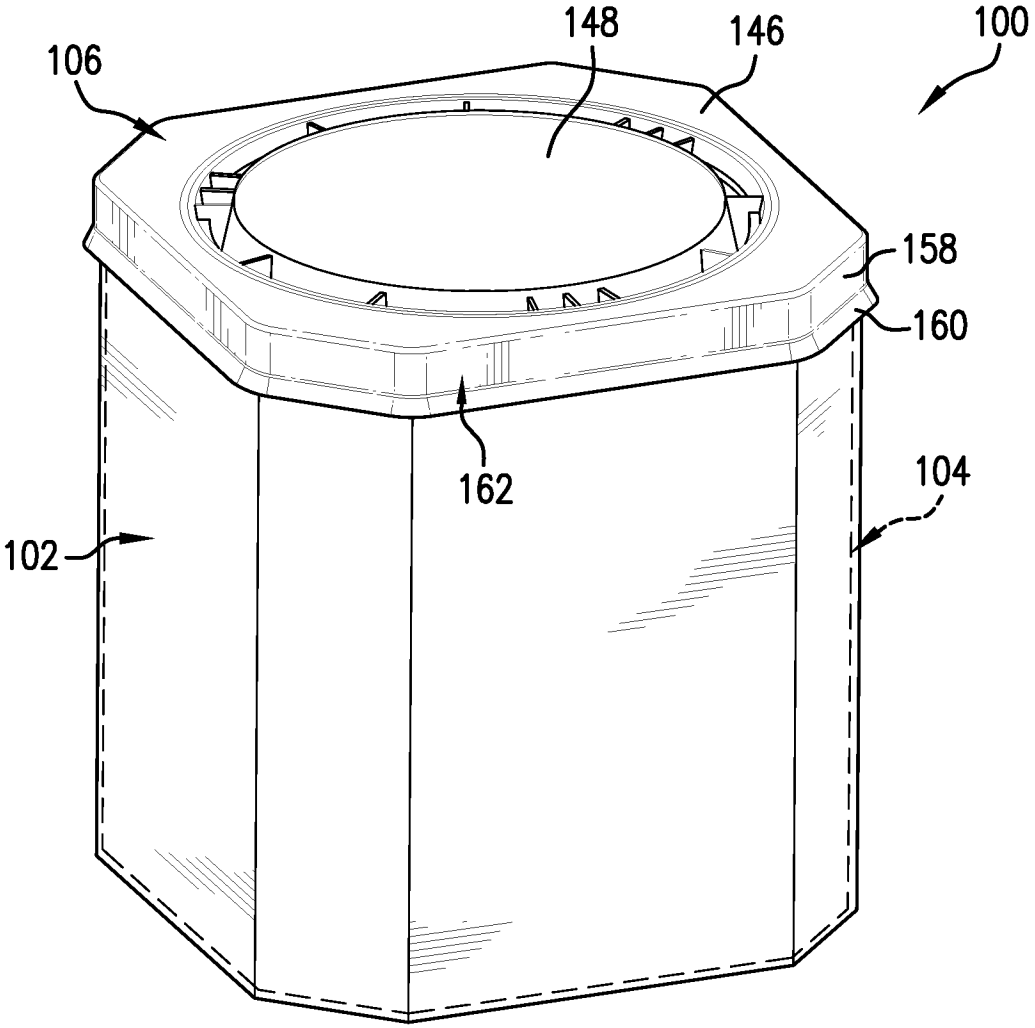
FIG. 1 is a perspective view of a container according to some embodiments.

Referring now to FIG. 1, a perspective view of one embodiment of a container 100 is shown. The container 100 may include a shell 102, a liner 104, and a lid 106. The shell 102 may be configured to define and maintain the shape of the container 100. The shell 102 may be further configured to support the contents of the container 100 both with respect to the weight of the contents and also with respect to any outwardly or inwardly directed forces imparted on the container 100 by the contents or otherwise. The liner 104 may be configured to nest within the shell 102 and provide a watertight or fluid tight membrane to maintain the contents and prevent leakage or other escape of the contents. The lid 106 may be configured for placement over an open top of the shell 102 and the liner 104 and may be configured to prevent leakage or other escape of the contents. The lid 106 may also be configured for providing access to the contents and for resealing the container 100 after accessing the contents.

Figure 2:
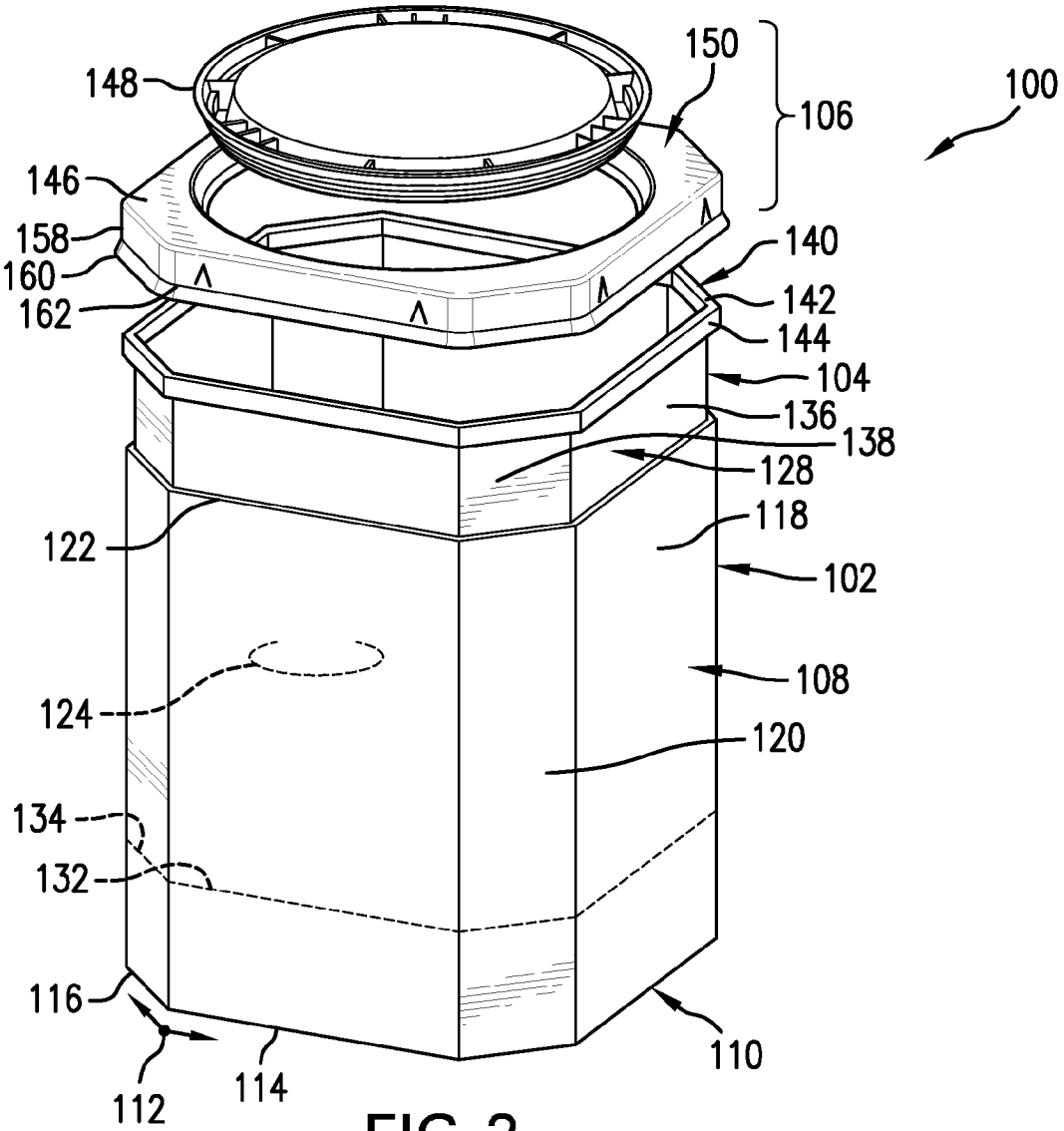
FIG. 2 is an exploded perspective view of the container of FIG. 1.

Referring now to FIGS. 1 and 2, the shell 102 is shown. The shell 102 may include a wall portion 108 and a bottom 110. The bottom 110 may provide a base for resting the container 100 on a surface and may also be configured for spanning across the bottom 110 of the container 100 and supporting the contents of the container 100 when the container 100 is being lifted or otherwise handled. In some embodiments, where, for example, alternative support for the contents is provided, the bottom 110 may be omitted.

Where provided, the bottom 110 may include a generally flat outer surface for resting the container 100 on a surface and may have a thickness and a material strength suitable for supporting the container contents. In some embodiments, the bottom 110 may be generally plate-like with two generally flat surfaces separated by a thickness. In some embodiments, the bottom 110 may include ribs or other structures extending along, across, or around the surface of the bottom 110 to stiffen or strengthen the bottom 110. In still other embodiments, the bottom 110 may include a plurality of overlapping portions of material similar to a box top, for example. In some embodiments, the overlapping portions may engage one another due to a pattern of folding and assembly and in other embodiments, adhesive tapes may be used. In still other embodiments, a combination of engaging folds and adhesive tapes may be used.

In some embodiments, the bottom 110 may be made from plastic, wood, cardboard, corrugated cardboard or other paper-based products, composite materials, or metal materials. Other materials may also be used. The thickness of the material may be selected based on the type of material used, the size of the container 100, and the type of material being placed in the container 100. In some embodiments, for example, the thickness of the bottom may range from approximately 1/16" to approximately 4", or from approximately 1/8" to approximately 1", or from approximately 3/16" to 1/4. In some embodiments the volume of the container may range from approximately 1/4 liter to approximately 50 liters. In other embodiments the volume may range from approximately 1 liter to approximately 20 liters. In still other embodiments, the volume may range from approximately 2 liters to approximately 10 liters. Other volumes may be provided including volumes outside the ranges mentioned.

The bottom 110 may include a periphery 112 with a circular, oval, oblong, or non-polygonal or regular or irregular polygonal shape (such as a rectangle, square, octagon, triangle, etc.), or other shape. The bottom shown in FIGS. 1 and 2, for example, has a generally octagonal periphery 112. That is, the periphery 112 includes eight edges and, while the edges may not all be equal in length, the periphery 112 remains generally octagonal. The shape of the periphery 112 in FIGS. 1 and 2 may also be described as generally square with clipped or mitered corners. Other shapes may also be provided.

In the embodiment shown, the edges forming the periphery of the bottom may include side edges 114 and corner edges 116. The side edges 114 may range in length from approximately 2" to approximately 12" while the corner edges 116 may range from approximately 1/2" to approximately 6". In other embodiments, the side edges 114 may range from approximately 4" to approximately 8" while the corner edges 116 may range from approximately 1" to approximately 4". In still other embodiments, the side edges 114 may be approximately 6" long while the corner edges 116 may be approximately 2 1/2" long. The corner edges 116 may be selected to be approximately 1/8 of the length to approximately equal to the length of the side edges 114. In other embodiments, the corner edges 116 may be selected to be approximately 1/4 to approximately 3/4 the length of the side edges 114. In still other embodiments, the corner edges 116 may be selected to be approximately 1/3 to approximately 1/2 of the length of the side edges 114. Other lengths of side edges 114 and corner edges 116 and ratios therebetween may be provided and suitable lengths may be selected based on several factors including the strength of the material and the nature and properties of the contents being stored in the container 100. That is, generally, longer edges may be reflective of larger parts of the wall portion 108 described below. Where the parts of the wall portion 108 are larger, the container 100 may generally be provided with relatively thicker or stronger materials and a designer may balance the lengths of the bottom periphery edges 114, 116 against the material implications. Any size or shape of container may be provided.

The wall portion 108 of the shell 102 may extend from the several edges 114, 116 of the periphery 112 of the bottom 110 of the shell 102. The wall portion 108 may include side portions 118 and corner portions 120 corresponding to the respective side edges 114 and corner edges 116 of the bottom 110. Each of the side portions 118 and corner portions 120 of the wall portion 108 may have a width substantially equal to the length of the corresponding bottom edge. The side portions 118 and corner portions 120 may extend upwardly and away from the bottom 110 and the several side portions 118 and corner portions 120 may be generally parallel to one another. The side portions 118 and corner portions 120 may include a length measured between the corresponding bottom edge and an opposing free edge. The several free edges of the side portions and corner portions may form a peripheral rim 122 of the shell. The peripheral rim 122 may be arranged at an opposite end of the shell 102 from the bottom 110 and may define an open top of the shell 102.

The wall portion 108 of the shell 102 may be constructed of materials similar to those discussed with respect to the bottom portion 110. In one embodiment, the wall portion 108 may be constructed of corrugated cardboard. In this embodiment, the cardboard may be oriented such that the flutes of the cardboard are arranged to extend along the length of the respective side portions 118 and corner portions 120 in a direction generally perpendicular to the bottom 110. As such, the side portions 118 and corner portions 120 may have a relatively high compressive strength for carrying loads directed along the height of the shell 102. That is, where loads are imposed on the peripheral rim 122 of the shell 102 and imparted along the shell 102 toward the bottom 110, the compressive strength of the shell 102 may be higher than if the corrugated cardboard were oriented other than described. However, other orientations may be provided and selected based on conditions anticipated during use of the container. The shell 102 may be integrally formed from a single piece of material that is folded to form the shell 102 and thus may include a collapsed or flattened position and an expanded position. Where integrally formed, the joints between the several side portions 118 and corner portions 120 may include fold lines or seams where parts join. Where seams are provided, tape such as packing tape, duct tape, or other tapes may be used to secure adjacent portions to one another. Adhesives or other securing systems, such as hook and loop, zippers, buttons, tabs and slots, and the like, may also be used. In other embodiments, the shell 102 may be formed of several parts and seams between parts may be secured similar to the seams between parts of the integrally formed shell 102 described. In some embodiments, some portions of the shell 102 may be integrally formed and other portions may be formed separately and secured thereto. As such, a combination of integrally or separate formation of the shell 102 may be provided.

The wall portion 108 of the shell 102 may also include handles 124. In some embodiments, the handles 124 may include perforated portions of the wall portion 108 that may be pushed or punched out to create an opening in the wall portion 108 through which a user may place fingers for lifting the container 100. In other embodiments, the handles 124 may be in the form of straps adhered to the side and/or corner portions 118, 120 of the wall portion 108. In some embodiments, an "under the bottom" system may include straps that extend from a handle 124 on one side of the container 100, around the bottom 110 of the shell 102, and up the other side of the container 100 to a second handle 124. In still other embodiments, an "over the top" system may include a strap that extends from one side of the container 100 across the top of the container 100 to the opposing side similar to a bucket handle, for example. In still other embodiments, a combination of "over the top" and "under the bottom" type strap systems may be used. Still other handle 124 configurations may be provided.

In one embodiment, the shell 102, including the bottom 110 and the wall portion 108, may be in the form of a polygonal collapsible bulk bin such as that described in U.S. Pat. No. 7,434,721, the contents of which are hereby incorporated by reference herein. Other assemblies of corrugated material or other material may also be provided to form the shell 102. For example, the shell 102 may include features similar to or the same as the carton or box described in U.S. patent application Ser. Nos. 12/620,446 and 12/767,981, the contents of each of these applications being hereby incorporated by reference herein in their entireties. The shell may also include features similar to or the same as the carton or box described in U.S. Patent Application Nos. 61/414,422 and 61/473,596, the contents of each of these applications being hereby incorporated by reference herein in their entireties. Still other shell assemblies and arrangements may be provided.

Figure 3:
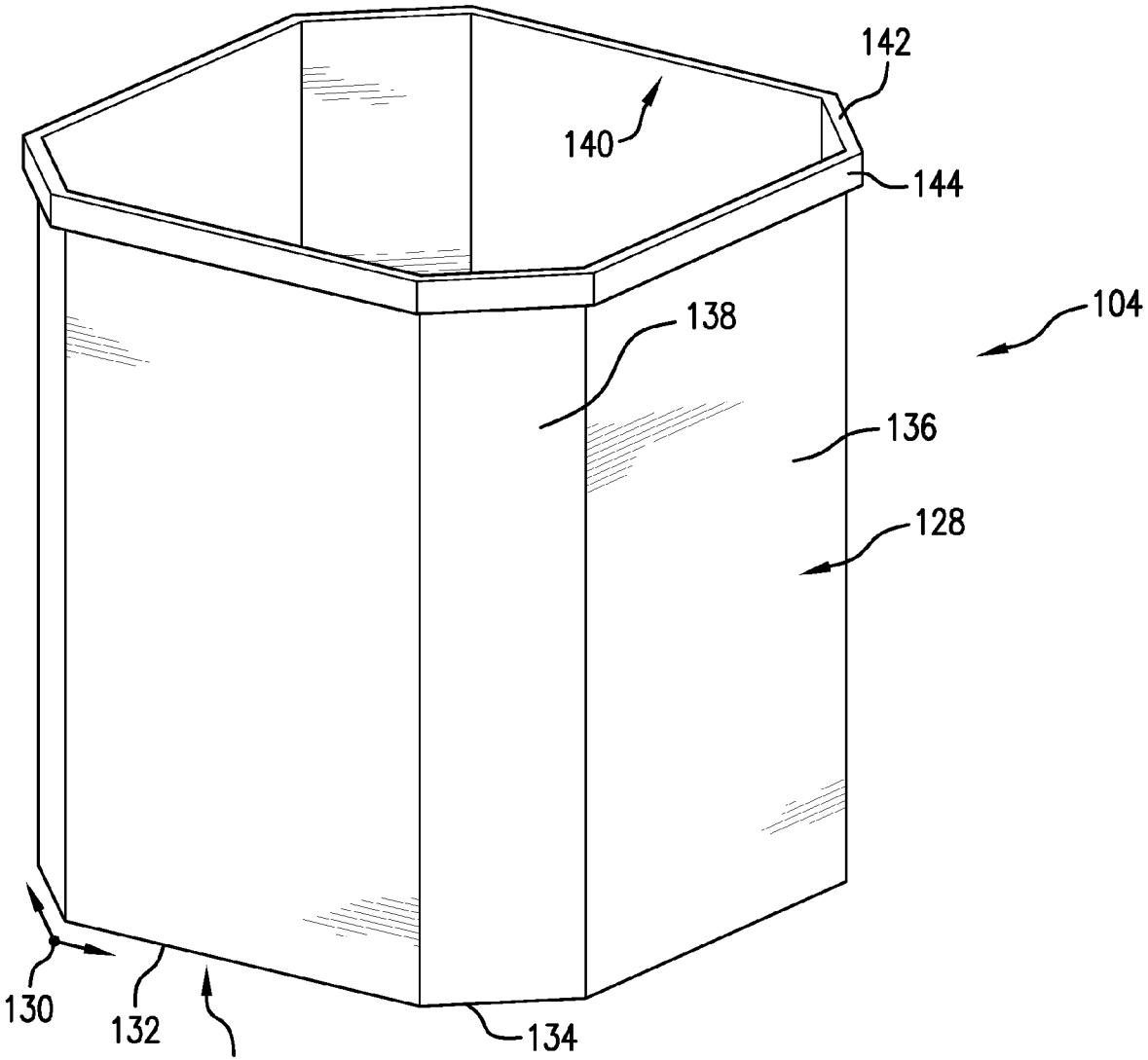
FIG. 3 is a perspective view of a liner of the container of FIG. 1.

Turning now to the liner 104, reference is made to FIGS. 2 and 3. The liner 104 may be a vacuum-formed liner 104 and, as such, may be sized and shaped with particular dimensions. As shown, the liner 104 may be configured for nestingly engaging the shell 102 via the open top of the shell 102. As such, the liner 104 may have a bottom 126 and a wall portion 128 similar to the shell 102, but slightly smaller, such that the liner 104 may be placed within the shell 102 and the several portions of the liner 104 may be arranged immediately adjacent to corresponding portions of the shell 102. As such, when contents are placed within the liner 104 and the liner 104 is within the shell 102, the position of the several portions of the liner 104 may be maintained by the shell 102 under forces or pressures exerted by the contents on the liner 104. Accordingly, the liner 104, like the shell 102, may include a bottom 126 having a periphery 130 comprising a plurality of side edges 132 and a plurality of corner edges 134 and the shape of the bottom 126 of the liner 104 may correspond to the shape of the bottom 110 of the shell 102. The liner 104 may also include a wall portion 128 having a plurality of side wall portions 136 and a plurality of corner wall portions 138 each extending from a corresponding side edge 132 and corner edge 134 of the liner bottom 126 respectively. Each of the side wall portions 136 and corner wall portions 138 may have a width substantially equal to a corresponding side edge 132 and corner edge 134 of the bottom 126 of the liner 104. Each of the side wall portions 136 and corner wall portions 138 may also extend away from the bottom 126 of the liner 104 to a free edge collectively forming a peripheral ribbon 140 defining an open top of the liner 104.

While the liner 104 has been described as having several particular parts and elements having particularly adapted sizes and shapes, in other embodiments the liner 104 may any suitable shape, including more bag-like, and may be placed within the shell 102 where the contents placed in the liner 104 may press outward on the liner 104 causing the liner 104 to conform to the shape of the shell 102. Other liner types and shapes may also be provided. For example, the liner 104 may include features similar to or the same as the liner 104 described in any or all of U.S. patent application Ser. Nos. 12/620,446, 12/767,981, 61/414,422, and 61/473,596. Still other liners types, shapes, and features may be provided.

The liner 104 may be made from any suitable material. Where the contents are liquids, a liquid impermeable material may be used such as a plastic, polyethylene, or other substantially liquid impermeable material. Where the contents are solids, a more permeable material may be used, such as a cloth material, netting, mesh, other material. A more impermeable material may also be used with solid contents. In some embodiments, the liner 104 may be a plastic material. The liner 104 may be a high-density polyethylene (HDPE) material or the liner 104 may be a low-density polyethylene (LDPE) material. As mentioned, the liner 104 may be vacuum-formed or other forming methods may be used. Still other materials may also be used.

The liner 104 may be configured to be engaged by the lid 106 to be described below. As such, the free edge of the liner 104 may form a peripheral ribbon 140 for engagement by the lid 106. In the embodiment, shown, the peripheral ribbon 140 includes a flange portion 142 and a return portion 144. The flange portion 142 may extend laterally outward and away from the center of the liner 104. The flange portion 142 may extend laterally a distance substantially equal to the thickness of the side wall 118 and corner wall 120 portions of the shell 102 and may terminate at an outer edge. The return portion 144 of the ribbon 140 may extend generally downward from the outer edge of the flange 142 and generally parallel to the side wall 118, 136 and corner wall 120, 138 portions of the liner 104 and shell 102. The return portion 144 may extend downward away from the flange portion 142 by a distance ranging from approximately 1/16" to approximately 4". In other embodiments, the return portion 144 may extend a distance ranging from approximately 1/8" to approximately 1/4". In still other embodiments, the return portion 144 may extend a distance ranging from approximately 1/4" to approximately 1/2". In still other embodiments, the return portion 144 may extend approximately 3/8". The flange portion 142 and return portion 144 may form a substantially channel-shaped peripheral ribbon 140 extending substantially continuously around the open top of the liner 104. While being configured for engagement by the lid 106, the channel-shaped peripheral ribbon 140 may also engage the peripheral rim 122 of the shell 102 allowing the weight of contents placed in the liner 104 to be transferred to the peripheral rim 122 of the shell 103 thereby supporting some or all of the liner 104 off of the shell 102. The engagement of the channel-shaped peripheral ribbon 140 may also secure the liner 104 in position relative to the shell 102.

It is noted that while a channel-shaped peripheral ribbon 140 portion has been described, other peripheral ribbon 140 shapes may be provided. That is, a peripheral ribbon 140 in the form of a plain peripheral edge on the top of the liner 104 may be provided and may be adapted, for example, to slide into a slit, slot, or groove, extending around the bottom of the lid 106 for securing the liner 104 to the lid 106 or adapted to be positioned adjacent to and secured to a downward extending tab for securing the liner 104 to the lid 106. In other embodiments, the peripheral ribbon 140 may include a flange portion 142 and a return portion 144 may be omitted. The flange portion 142 of the peripheral ribbon 140 may be secured to the underside of the lid 106. In still other embodiments, the peripheral ribbon 140 may be include a rolled free edge of the liner 104, for example. The rolled free edge may be configured for press fitting into a slot or opening in the bottom of the lid 106 where the slot or opening may be a plain slot or the slot may lead to an open or broader space allowing the rolled free edge to expand once inserted and/or pressed through the slot thereby securing the liner 104 to the lid 106. Still other peripheral ribbon 140 configurations may be provided.

Other features may be provided and any or all of the features may be continuous around the perimeter of the open top of the liner 104 or intermittent or varying features may be provided. It is further noted that, while the channel-shaped peripheral ribbon 140 has been described as engaging both the peripheral rim 122 of the shell 102 and also engaging the lid 106, the peripheral ribbon 140 on the liner 104 may engage one or the other. For example, the liner 104 may extend upward from the shell 102 and engage the underside of the lid 106 without any particular engagement with the peripheral rim 122 of the shell 102.

Turning now to the lid 106, reference is made to FIGS. 1, 2, 4, and 5. As shown, the lid 106 may include a peripheral portion 146 and an access portion 148. The peripheral portion 146 may be configured for engagement with the liner 104 to form a leak free seam thereby maintaining the contents in the space defined by the liner 104 and the lid 106. The peripheral portion 146 of the lid 106 may also be configured for engagement with the shell 102. The access portion 148 may be operably or removably secured to the peripheral portion 146 and may be configured for accessing the contents stored in the container 100.

The peripheral portion 146 of the lid 106 may include a top 150 and a shell/liner engaging portion 152. The top 150 of the peripheral portion 146 of the lid 106 may be a generally flat, plate-like, element having a peripheral edge generally matching the shape of the shell 102 and being slightly larger than the peripheral rim 122 of the shell 102. In the embodiment shown, the peripheral edge of the top 150 may be generally octagonal. The top 150 of the peripheral portion 146 may have an inner edge corresponding to the shape of the access portion 148. In the embodiment shown, the inner edge may be generally circular or round. The top 150 of the lid 106 may include an engagement feature 154 arranged along the inner edge for engagement with the access portion 148. The engagement feature 154 is discussed below in conjunction with the access portion 148.

The shell/liner engaging portion 152 of the peripheral portion 146 of the lid 106 may be arranged along the peripheral edge of the top 150. The shell/liner engaging portion 152 may include an inner guide 156, an outer guide 158, or both. The outer guide 158 may extend generally downward from the peripheral edge of the top 150 and may be arranged generally perpendicular to the top 150 and generally parallel to the wall portion 108 of the shell 102. As such, when the lid 106 is placed on the shell 102, the outer guide 158 may sleevably engage the shell 102 of the container 100. The inner guide 156 may extend generally downwardly from the top 150 of the peripheral portion 146 and may be spaced apart from the outer guide 158 a distance similar to the thickness of the liner 104 and the shell 102. As shown, the liner 104 may include a channel-shaped peripheral ribbon 140 along its top edge, which may engage the peripheral rim 122 of the shell 102. As such, the spacing between the inner guide 156 and the outer guide 158 of the shell/liner engaging portion 152 may be substantially equal to twice the thickness of the liner 104 plus the thickness of the shell 102. Additional space between the inner and outer guide 156, 158 may be provided to facilitate smooth placement of the lid 106 on the liner 104 and the shell 102 and to further facilitate movement of adhesive throughout the height of the engaging portion 152. As shown, the outer guide 158 may also include a flared portion 160 extending from a bottom edge thereof to facilitate alignment of the outer guide portion 158 with the outer surface of the shell 102.

Figure 5:
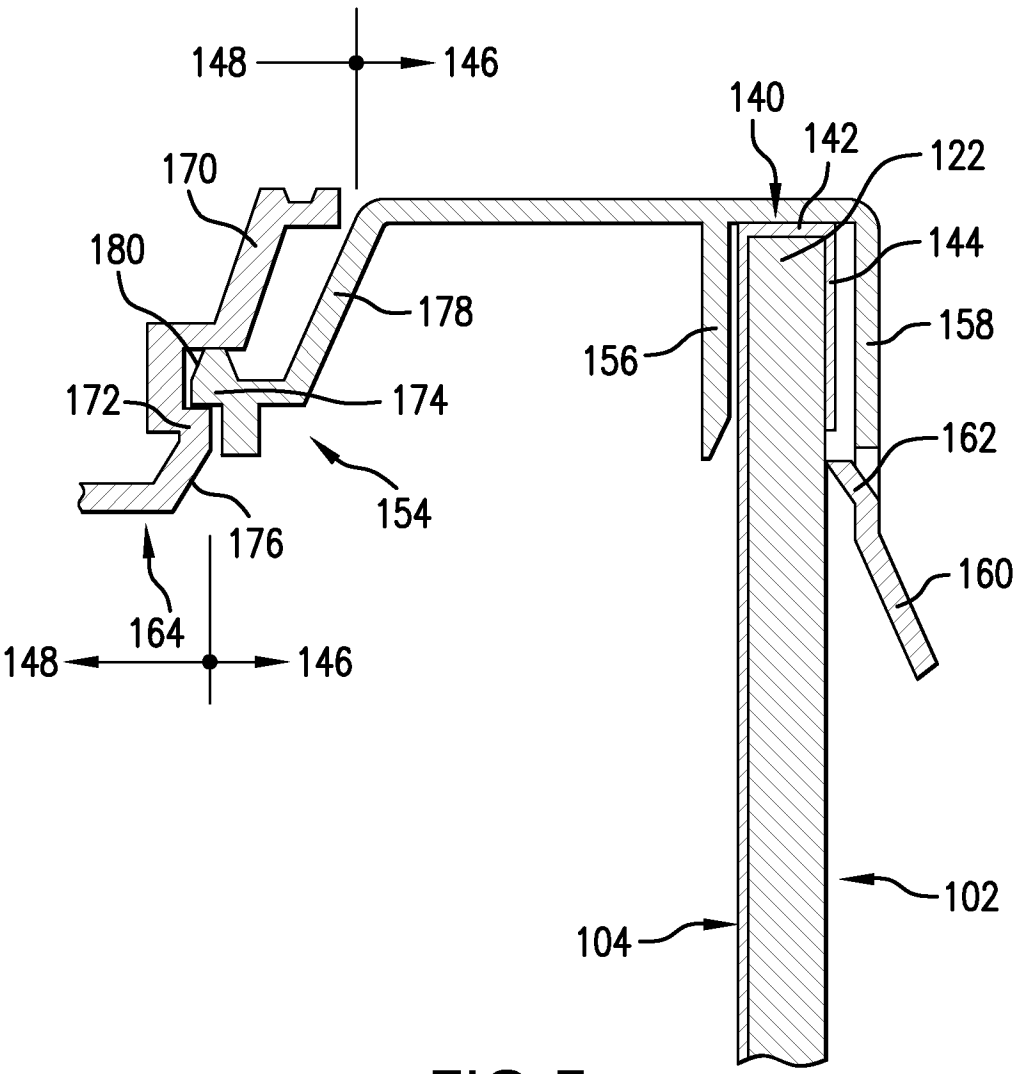
FIG. 5 is a cross-sectional view of the portion of the container shown in FIG. 3.

In some embodiments, as shown, the shell/liner engaging portion 152 may optionally be generally channel-shaped and may be particularly adapted to receive the channel-shaped peripheral ribbon 140 of the liner 104. The shell/liner engaging portion 152 may include a bead of hot-melt glue arranged along its length between the inner and outer guides 156, 158 and adjacent an underside of the top 150 of the peripheral portion 146 of the lid 106. Other adhesives or liner and/or shell securing systems or devices may also be provided along the length of the shell/liner engaging portion 152. For example, in some embodiments, as shown in FIGS. 2 and 5, a lid retainer 162 may be provided. The lid retainer 162 may be arranged on the outer guide portion 158 of the shell/liner engaging portion 152. The lid retainer 162 may include a deflectable portion of the outer guide 158 and may be in the form of a triangular cutout, for example. That is, as shown, the lid retainer 162 may be formed by providing a chevron slit directed upward in the outer guide portion 158 creating a generally triangular lid retainer 162. The triangular lid retainer 162 may be bent or directed slightly inward as shown in FIG. 5, for example, such that when the lid 106 is placed on the shell 102 and liner 104, the lid retainer 162 may sweep along the outer surface of the shell 102 and liner 104. However, when the lid 106 is attempted to be removed, the point of the triangular-shaped lid retainer 162 may bite into the outer surface of the liner 104 and shell 102, thereby resisting removal of the lid 106. It is noted that in some embodiments, where a bead of hot-melt glue in the channel-shaped shell/liner engaging portion 152 is insufficient to secure the lid 106 to the shell 102, but, rather, secures the lid 106 solely to the liner 104, the described lid retainer 162 may resist removal of the lid 106 and liner 104 from the shell 102 of the container 100. Other systems such as friction or a snap fit, an internal or external threaded connection, a gasketed and latched connection, a toothed or other biting-type feature, or other connection systems may also be used. However, in some embodiments, as shown, the outer guide portion 158 of the shell/liner engaging portion 152 may extend downward along the shell 102 a distance greater than that of the liner 104 and a sufficient amount of hot-melt glue may be provided such that a portion of the glue may be squeezed down along the outer guide 158 beyond the return portion 144 of the liner 104 and adhere the outer guide 158 to the outer surface of the shell 102. In some embodiments, both a sufficient amount the hot-melt glue and the lid retainers 162 may be provided such that both elements function to secure the lid 106 to the shell 102.

The peripheral portion 146 of the lid 106 may also include stiffeners. The stiffeners may include one or more ribs arranged along the underside of the top 150 and within the inner guide 158 of the shell/liner engaging portion 152.

The access portion 148 of the lid 106 may be configured for placement, removal, and replacement on the peripheral portion 146 thereby providing repeated selective access to the contents of the container 100. As such, the access portion 148 may be a threaded lid (e.g., external or internally threaded lid), a snap-on lid, a plate-like lid, or a hinged lid, for example. The access portion 148 may include a seal or gasket for sealing the access portion 148 to the peripheral portion 146. The access portion 148 may also include a securing device such as a latch or hasp, for example, for securing the access portion 148 to the peripheral portion 146. In some embodiments, the latch may be a pull-type latch that pulls the access portion 148 against the peripheral portion 146 so as to seal the access portion 148 when the latch is closed. Other openable and replaceable lid styles may also be used or incorporated.

Figure 4:
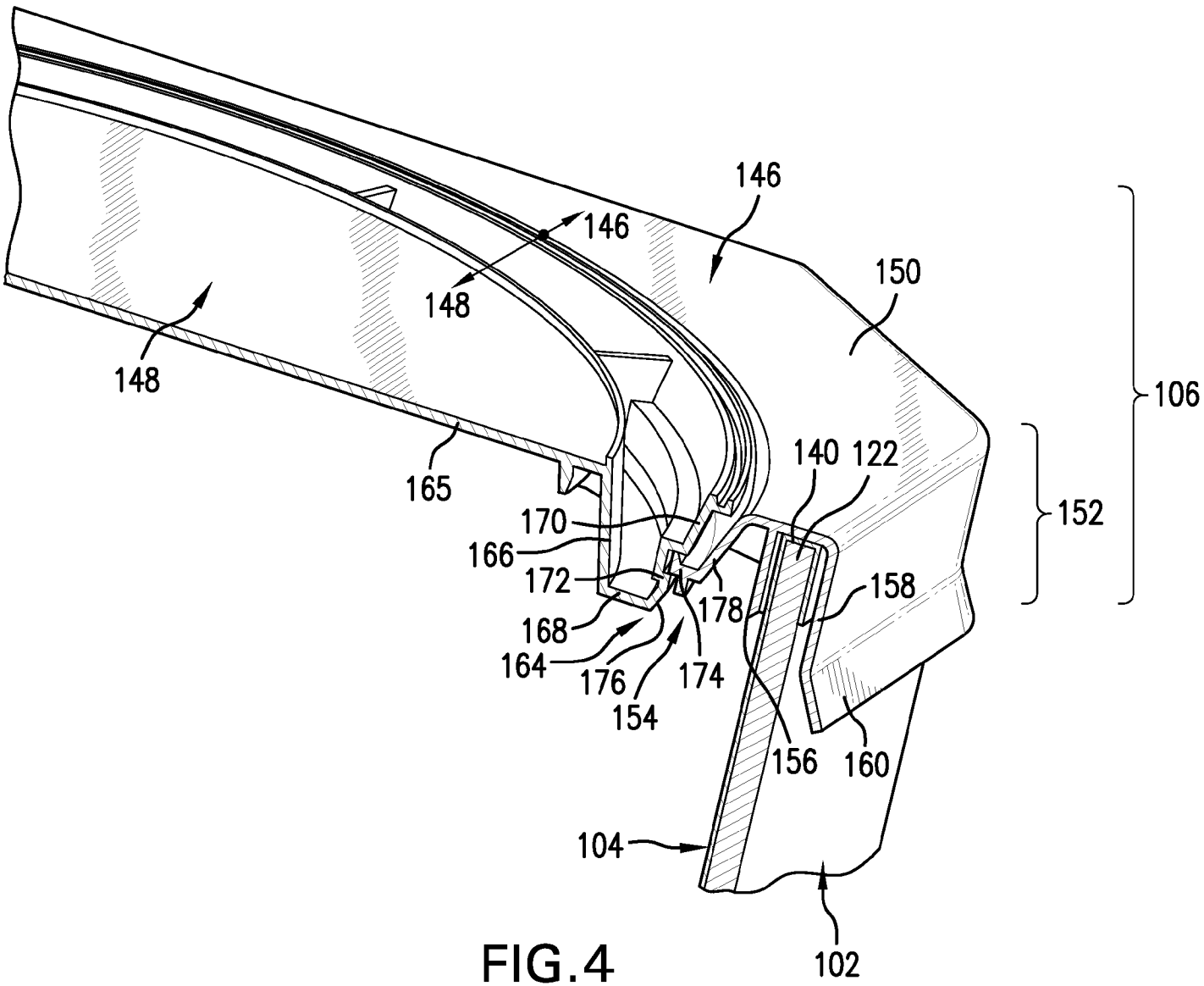
FIG. 4 is a close-up perspective sectional view of a portion of the container of FIG. 1 where the shell, liner, and lid join with one another.

The access portion 148 may be any shape including round, square, triangular, octagonal, oblong, oval, or other shape. In the embodiment shown, the access portion 148 is generally round having a central portion 165 and a peripheral portion. The peripheral portion may include an engagement feature 164 adapted to engage the engagement feature 154 arranged along the inner edge of the top 150 of the peripheral portion 146 of the lid 106. As shown in FIGS. 4 & 5, for example, the engagement feature 164 on the access portion 148 may include a generally trough-shaped assembly arranged along the perimeter of the central portion 165. The trough-shaped assembly may include a slightly sloping inner wall 166 extending downward from the central portion 165, a bottom 168, and a slightly sloping outer wall 170 extending upward from the bottom 168 and back up to a height substantially equal to the position of the central portion 165. The outer wall 170 of the trough may include a catch 172 adapted to engage a corresponding catch 174 on the peripheral portion 146 of the lid 106. As shown, the catch 172 on the outer wall 170 of the trough may be in the form of a upward facing ledge. The outer wall may also include a cam surface 176 allowing the access portion 148 to slide past the catch 174 on the peripheral portion 146 when placing or replacing the access portion 148.

The engagement feature 154 on the peripheral portion 146 of the lid 106 may be configured for engagement with the engagement feature 164 on the access portion 108. As shown, the engagement feature 154 on the peripheral portion 146 may include a generally downward sloping wall 178 arranged generally parallel to the upward sloping wall 170 of the trough-shaped assembly on the access portion 148. The downward sloping wall 178 on the peripheral portion 146 may include a catch 174 arranged on its downward most edge. The catch 174 may include a generally downward facing surface adapted for abutting the upward facing surface on the access portion 148. The catch 174 on the peripheral portion 146 may also include a cam surface 180 adapted for slidingly engaging the cam surface 176 on the access portion 148 when the access portion 148 is placed or replaced. The cam surfaces 176, 180 may function to bias the respective catches 172, 174 away from one another as the access portion 148 is advanced into position until the respective upward and downward facing surfaces slip past one another allowing the catches 172, 174 to spring back to the natural position placing the upward and downward facing surfaces in abutting relationship.

To remove the access portion, a prying device such as a flat screwdriver or paint can opener may be used between the upward sloping wall 170 of the trough-shaped assembly and the downward sloping wall 178 of the peripheral portion 146. The prying device may be used to separate the upper edge of the upward sloping wall 170 from the downward sloping wall 178 thereby causing one or both of the walls to deflect and sliding the upward facing surface and downward facing surface along one another to separate then and allowing the catch 172 on the access portion 148 to move upward and past the catch 174 on the peripheral portion 146. The circular nature of the access portion 148 may then allow for this separation to propagation along the perimeter of the access portion 148 freeing the access portion 148 from the peripheral portion 146 and providing access to the contents. When replacing the access portion 148, pressure may be provided along the perimeter of the access portion 148 causing the respective cam surfaces 176, 180 of the access portion 148 and peripheral portion 146 to engage one another and deflect the respective walls 170, 178 of the engagement features 164, 154 allowing them to slide past one another and springing the upward facing and downward facing surfaces into contact with one another.

The lid 106, including the peripheral portion 146 and the access portion 148 may be made of any material. In one embodiment, the lid 106 may be an injection molded lid. As such, the lid 106 may be constructed of a plastic material or other injectable material. Other materials and processes for forming the lid 106 may also be used. In some embodiments, a portion of the lid 106 such as the access portion 148, for example, may be made of a relatively clear or semi-transparent material such that the contents and the color thereof may be viewed without removing the access portion 148.

In use, the described container 100 may be used for several types of contents. In one embodiment, the container 100 may be used to store, transport, and handle, liquids. In some embodiments, the shell 102 may be expanded from a flat state, for example, into the octagonal shape described above or other shaped container. The liner 104 may also be expanded from a collapsed state to an expanded state and may be placed in the shell 102 and the channel-shaped peripheral ribbon 140 of the liner 104 may allow for the liner 104 to be suspended from the peripheral rim 122 of the shell 102. The liner 104 may be filled with the intended contents. The lid 106, including at least the peripheral portion 146, may be arranged on the shell 102 and the liner 104 and may be pressed such that the liner/shell engaging portion 152 slides over the peripheral rim 122 of the shell 102 and the liner 104. A hot-melt glue positioned in the shell/liner engaging portion 152 may be preheated such that when the lid 106 is pressed onto the shell 102 and the liner 104, the hot-melt glue adheres the lid 106 to at least the liner 104 and, in some embodiments, the liner 104 and the shell 102. Where lid retainers 162 are provided, the lid retainers 162 may engage the shell 102 when the lid 106 is pressed thereon. The access portion 148 may be pre-placed in the peripheral portion 146 before placing the peripheral portion 146 onto the shell 102 and the liner 104 or the access portion 148 may be later placed.

The container 100 described herein may be advantageous for several reasons. The several parts of the container 100 may be recyclable and/or collapsible and thus reduce the carbon footprint in landfills, during shipping, and during manufacturing. For example, the shell may be removed after use and collapsed and recycled. The liner may be collapsed and the liner and lid may take up far less room in a landfill than known paint cans, for example. In addition, the container 100 may take up less space in a warehouse due to its collapsibility and close packing ability. Moreover, and for similar reasons, the container 100 may have lower fuel shipping costs and manufacturing costs than known paint cans.

Additional advantages of the presently described container 100 relate to its weight. The shell 102, the liner 104, and the lid 106 may be considerably lighter than a paint can and may thus reduce shipping costs and fuel consumption. Moreover, the collapsible nature of the shell 102 and liner 104 may allow for unfilled containers to be stored in a collapsed state thereby reducing warehouse space needed for stock piling empty containers 100. The surface area available on the current disclosed container 100 may be larger and flatter than round paint cans thereby increasing the amount of space available for marketing information on the container 100. Moreover, the current disclosed container 100 may pack more densely when arranged in a rectangular or other array on a pallet for example. Still further, where a clear or semi-transparent portion of the lid 106 is provided, the user may be able to see the paint color without having to open the container 100.

While the present disclosure has been described with reference to various embodiments, including preferred embodiments, it will be understood that these embodiments are illustrative and that the scope of the disclosure is not limited to them. Many variations, modifications, additions, and improvements are possible. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A container for holding contents, comprising:

a shell having a peripheral rim defining a substantially open top;

a lid including a peripheral portion that surrounds an access portion, wherein the lid is positioned on the shell, covering the substantially open top, and the peripheral portion surrounds the peripheral rim, and wherein the lid has a retaining feature which bites into an outer surface of the shell to resist removal of the lid from the shell; and a liner disposed within the shell and having a liner periphery with a flange portion extending outwardly and a return portion extending downwardly from the flange portion with the flange portion and the return portion extending around the peripheral rim of the shell, and the lid forming a continuous seal between the liner and the lid.

2. The container of claim 1, wherein the peripheral portion of the lid includes a continuous peripheral channel nestingly engaging the peripheral rim.

3. The container of claim 2, wherein the liner periphery includes a continuous peripheral channel nestingly engaging the peripheral rim, the liner periphery being arranged between the peripheral portion of the lid and the peripheral rim of the shell.

4. The container of claim 3, wherein the periphery of the liner is secured to the peripheral portion of the lid with an adhesive.

5. The container of claim 1, wherein the retaining feature includes a triangular-shaped protrusion.

6. The container of claim 1, the liner is sufficiently flexible to conform to the shape of the shell in response to receiving contents that press outward on the liner.

7. The container of claim 1, wherein shell is made of cardboard.

8. A container for holding contents, comprising:

a shell having a peripheral rim defining a substantially open top;

a liner disposed within the shell, and having a periphery with a flange portion extending outwardly over the peripheral rim of the shell, the liner being sufficiently flexible to conform to the shape of the shell in response to receiving contents that press outward on the liner; and a lid including a peripheral portion attached to the liner and a removable access portion that provides access to the interior of the liner, wherein the lid is positioned on the shell covering the substantially open top—and is directly engaged to the shell thereby resisting removal of the lid from the shell, with the lid forming a substantially continuous seal between the liner and the lid.

9. The container of claim 8, wherein the substantially continuous seal is a liquid tight seal between the lid and the liner.

10. The container of claim 8, wherein an adhesive connects the shell to the liner.

11. The container of claim 8, wherein an adhesive connects the liner to the lid.

12. The container of claim 8, wherein the retaining feature works together with an adhesive to connect the lid to the shell.

13. The container of claim 8, wherein the access portion is removably sealed to the peripheral portion with a liquid tight seal.

14. The container of claim 8, wherein the lid has a retaining feature which bites into an outer surface of the shell to resist removal of the lid from the shell.

15. A container for holding contents, comprising:

a shell having a peripheral rim defining a substantially open top;

a liner disposed within the shell and having a periphery with a flange portion extending outwardly over the peripheral rim of the shell;

a lid including a peripheral portion attached to the liner and a removable access portion that provides access to the interior of the liner, wherein the lid is positioned on the shell covering the substantially open top and is directly engaged to the shell thereby resisting removal of the lid from the shell, with the lid forming a substantially continuous seal between the liner and the lid; and an adhesive that connects the lid to the shell.

16. The container of claim 15, wherein the liner is sufficiently flexible to conform to the shape of the shell in response to receiving contents that press outward on the liner.

17. A container for holding contents, comprising:

a shell having a peripheral rim defining a substantially open top;

a liner disposed within the shell, and having a periphery with a flange portion extending outwardly over the peripheral rim of the shell;

a lid including a peripheral portion attached to the liner and a removable access portion that provides access to the interior of the liner, wherein the lid is positioned on the shell covering the substantially open top—and is directly engaged to the shell thereby resisting removal of the lid from the shell; and an adhesive that connects the lid to the liner to form a substantially continuous liquid-tight seal between the lid and the liner.

18. The container of claim 17, wherein the liner is sufficiently flexible to conform to the shape of the shell in response to receiving contents that press outward on the liner.

19. The container of claim 17, wherein the lid has a retaining feature which bites into an outer surface of the shell to resist removal of the lid from the shell.

20. A container for holding contents, comprising:

a shell having a peripheral rim defining a substantially open top;

a lid including a peripheral portion that surrounds an access portion, wherein the lid is positioned on the shell, covering the substantially open top, and the peripheral portion surrounds the peripheral rim; and a liner disposed within the shell, having a liner periphery with a flange portion extending outwardly and a return portion extending downwardly from the flange portion with the flange portion and the return portion extending around the peripheral rim of the shell, and the lid forming a continuous seal between the liner and the lid;

wherein the peripheral portion of the lid includes a continuous peripheral channel engaging the peripheral rim, and the liner periphery includes a continuous peripheral channel engaging the peripheral rim, the liner periphery being arranged between the peripheral portion of the lid and the peripheral rim of the shell; and wherein the periphery of the liner is secured to the peripheral portion of the lid with an adhesive.

21. The container of claim 20, wherein the liner is sufficiently flexible to conform to the shape of the shell in response to receiving contents that press outward on the liner.

22. The container of claim 20, wherein the adhesive is a hot glue melt.

23. A container for holding contents, comprising:

a shell having a peripheral rim extending about a top opening of the shell to define a substantially open top of the shell;

a lid that includes:

a peripheral portion configured as a narrow boarder defining a large opening that occupies a majority of the top opening;

an access portion surrounded by the peripheral portion and covering the large opening, an engagement feature disengageably engaging the access portion to the peripheral portion to close the large opening, and a retaining feature that positively engages the shell; and a liner disposed within the shell and having a liner periphery with a flange portion extending outwardly and a return portion extending downwardly from the flange portion, the flange portion and the return portion extending around the peripheral rim of the shell.

24. The container of claim 23, wherein the access portion is threaded into the peripheral portion.

25. The container of claim 23, wherein the peripheral portion is sealed to the liner, and the access portion is sealed to the peripheral portion.

26. The container of claim 23, wherein the lid forms a continuous seal between the liner and the lid.

27. The container of claim 23, wherein an adhesive connects the lid to the liner.

28. The container of claim 23, wherein the liner is sufficiently flexible to conform to the shape of the shell in response to receiving contents that press outward on the liner, and wherein the peripheral portion is sealed to the liner.

29. The container of claim 28, wherein the access portion is sealed to the peripheral portion.

* * * * *